US011692562B2

(12) United States Patent
Chen et al.

(10) Patent No.: US 11,692,562 B2
(45) Date of Patent: Jul. 4, 2023

(54) SILENCING DEVICE AND COMPRESSOR

(71) Applicant: ANHUI MEIZHI COMPRESSOR CO., LTD., Anhui (CN)

(72) Inventors: Xinjie Chen, Anhui (CN); Gang Huang, Anhui (CN)

(73) Assignee: ANHUI MEIZHI COMPRESSOR CO., LTD., Anhui (CN)

( * ) Notice: Subject to any disclaimer, the term of this patent is extended or adjusted under 35 U.S.C. 154(b) by 295 days.

(21) Appl. No.: 17/136,110

(22) Filed: Dec. 29, 2020

(65) Prior Publication Data

US 2021/0115947 A1 Apr. 22, 2021

Related U.S. Application Data

(63) Continuation of application No. PCT/CN2020/072592, filed on Jan. 17, 2020.

(30) Foreign Application Priority Data

Feb. 20, 2019 (CN) ..... 201910125399.9

(51) Int. Cl.
*F04D 29/66* (2006.01)
*F04D 29/063* (2006.01)

(52) U.S. Cl.
CPC ..... *F04D 29/66* (2013.01); *F04D 29/063* (2013.01)

(58) Field of Classification Search
CPC .... F25B 43/02; F04C 29/026; F04B 39/0061; F04D 29/66; F04D 29/40; F04D 29/063
See application file for complete search history.

(56) References Cited

U.S. PATENT DOCUMENTS 4,662,190 A * 5/1987 Tischer ..... F25B 1/047 62/84
4,957,517 A 9/1990 Linnert
(Continued)

FOREIGN PATENT DOCUMENTS

CN 101629563 A 1/2010
CN 101684787 A 3/2010
(Continued)

OTHER PUBLICATIONS

Notice of Reasons for Refusal dated Nov. 16, 2021 received in Japanese Patent Application No. JP 2020-573191 together with an English language translation.
(Continued)

*Primary Examiner* — Sabbir Hasan
*Assistant Examiner* — Jackson N Gillenwaters
(74) *Attorney, Agent, or Firm* — Scully, Scott, Murphy & Presser, P.C.

(57) ABSTRACT

A silencing device and a compressor having the silencing device are disclosed. The silencing device has a housing. An air inlet and an air outlet are provided to the housing. An air flow channel is provided in the housing for allowing air communication between the air inlet and the air outlet. An oil hole is provided in the housing for discharging oil from the housing. An oil guide part is arranged on the outside of the housing and at a position downstream of the oil hole in the moving direction of the oil, such that the oil drips from the housing after flowing from the oil hole to the oil guide part.

17 Claims, 3 Drawing Sheets

(56) References Cited

U.S. PATENT DOCUMENTS

| | | | | |
|---|---|---|---|---|
| 8,147,575 | B2 * | 4/2012 | Lucas | F04C 29/026 55/447 |
| 10,527,331 | B2 * | 1/2020 | Mullis | F25B 43/003 |
| 2008/0145242 | A1 | 6/2008 | Seibel et al. | |
| 2011/0271709 | A1 * | 11/2011 | Kinjo | F04B 39/0061 417/410.1 |
| 2013/0020146 | A1 | 1/2013 | Pawelski et al. | |
| 2021/0215146 | A1 * | 7/2021 | Heng | F04B 39/0061 |

FOREIGN PATENT DOCUMENTS

| | | | |
|---|---|---|---|
| CN | 102720655 | B | 7/2014 |
| CN | 107842482 | A | 3/2018 |
| CN | 207420814 | U | 5/2018 |
| CN | 207989256 | U | 10/2018 |
| CN | 109469599 | A | 3/2019 |
| JP | H02-301696 | A | 12/1990 |
| JP | H04-190819 | A | 7/1992 |
| JP | H05-069381 | U | 9/1993 |
| JP | 2000-130147 | A | 5/2000 |
| JP | 2001-271745 | A | 10/2001 |
| JP | 2013-083225 | A | 5/2013 |
| KR | 2001-0054580 | A | 7/2001 |

OTHER PUBLICATIONS

International Search Report dated Apr. 15, 2020 received in International Application No. PCT/CN2020/072592 together with an English language translation.

Notification of the First Office Action dated Feb. 8, 2021 received in Chinese Patent Application No. CN 201910125399.9 together with an English language translation.

* cited by examiner

SILENCING DEVICE AND COMPRESSOR

CROSS-REFERENCES TO RELATED APPLICATIONS

The present application is a continuation application of PCT International Application No. PCT/CN2020/072592, filed on Jan. 17, 2020, which claims the priority of Chinese Patent Application No. 201910125399.9, filed with the China National Intellectual Property Administration on Feb. 20, 2019 and entitled "SILENCING DEVICE AND COMPRESSOR", the entire contents of which are herein incorporated by reference for all purposes. No new matter has been introduced.

FIELD

The present disclosure relates to the technical field of compressors, and particularly relates to a silencing device and a compressor comprising the silencing device.

BACKGROUND

Currently, miniaturization and high efficiency of compressors have become a trend, which, however, also brings forth a series of problems, such as reduced suction efficiency, increased noise, and large oil discharge amount. Performance, noise and oil discharge amount have always been important parameters for evaluating a compressor. Loud noise affects the quality and reputation of the compressor; and large oil discharge amount will affect the performance of the compressor, and may even cause "ice blockage". In the related art, during the release of a gas entering a silencing chamber from an inlet of a silencer to a silencing space, the flow rate of a refrigerant gas will be decreased, which allows separation of some refrigerant oil, but most of the refrigerant gas will still enter a compression chamber. The existing suction silencers are all trying to achieve miniaturization while maintaining the internal shape, so they cannot obtain enough silencing quantity, cannot attenuate pulsation sound, and will also incur a phenomenon of compressing the refrigerant gas containing a lot of refrigerant oil, resulting in deterioration of the compression performance.

SUMMARY

The present disclosure aims to solve at least one of the technical problems existing in the prior art or the related art.

To this end, a first aspect of the present disclosure provides a silencing device.

A second aspect of the present disclosure further provides a compressor.

In view of this, the first aspect of the present disclosure proposes a silencing device, comprising: a housing, provided with an air inlet and an air outlet and is internally provided with an air flow channel, and the air inlet and the air outlet are in communication with each other by means of the air flow channel; an oil hole, provided in the housing for discharging oil from the housing; and an oil guide part, arranged on the housing and located on an outer side of the housing, wherein the oil guide part is arranged below the oil hole in a direction of dripping of oil, such that oil drips after flowing from the oil hole to the oil guide part.

The silencing device provided by the present disclosure comprises a housing, and an oil hole and an oil guide part provided on the housing. The housing is provided with an air inlet and an air outlet. A refrigerant gas can enter through the air inlet, pass through the air flow channel, and flow out from the air outlet after being subjected to an oil-gas separation in the air flow channel. The resultant oil flows out through the oil hole. The oil guide part is arranged on the outer side of the housing and located below the oil hole, so that oil will flow to the oil guide part after flowing out from the oil hole. The oil guide part increases the surface adsorption force of the oil, such that the oil can better converge; and when reaching a certain gravity, a converged oil drop can quickly drip into the bottom of a housing of a compressor, such that the oil discharge amount of the compressor can be effectively reduced, and stable internal oil circulation is ensured, thereby facilitating a reduction in the noise of the compressor.

Furthermore, the oil hole is provided in a lower part of the housing, and is located downstream of an air flow in the air flow channel, to facilitate the oil's flowing out of the housing.

The silencing device provided according to the present disclosure may also have the following additional technical features.

In the above embodiment, furthermore, the oil hole is provided on a side wall of the housing, and the oil guide part is located on a bottom wall of the housing.

In this embodiment, the oil hole is provided on the side wall of the housing, which facilitates the outflow of oil in the housing. The oil guide part is provided on the bottom wall of the housing. After flowing out from the oil hole, oil flows along the side wall of the housing to the bottom wall of the housing. Providing the oil guide part on the bottom wall of the housing is more conducive to converging the oil, so that the oil drips quickly, thereby reducing the oil discharge amount of the compressor. The oil hole may also be provided on the bottom wall of the housing.

In any of the above embodiments, furthermore, the housing comprises: an air inlet pipe, the air inlet being arranged on the air inlet pipe and communicated with the air flow channel through the air inlet pipe; an air outlet pipe, the air outlet being communicated with the air flow channel through the air outlet pipe, wherein the oil hole is arranged on an extension line of the air inlet pipe in an air inflow direction.

In this embodiment, the housing comprises an air inlet pipe and an air outlet pipe, and the oil hole is arranged on an extension line of the air inlet pipe in an air inflow direction, that is, the oil hole is arranged in the flowing direction of the refrigerant gas. The refrigerant gas enters from the air inlet and flows to the air flow channel through the air inlet pipe. To arrange the oil hole in the gas flowing direction is more conducive to discharging the oil in the housing.

In any of the above embodiments, furthermore, the silencing device further comprises: an oil baffle plate arranged on the housing and located on a peripheral side of the oil hole.

In this embodiment, the silencing device further comprises an oil baffle plate located on the peripheral side of the oil hole. After flowing out from the oil hole, the oil may adhere to the vicinity of the oil hole or flow to other places. In order to prevent the oil discharged from the housing from being sucked into the housing again, an oil baffle plate is arranged on the peripheral side of the oil hole, which, on the one hand, prevents the oil from being sucked into the housing again; and on the other hand, blocks the oil so that the oil flows towards the oil guide part.

In any of the above embodiments, furthermore, the oil baffle plate is arc-shaped and is arranged in a circumferential direction of the oil hole, wherein an opening is provided on the oil baffle plate, and the opening is provided to face the oil guide part.

In this embodiment, the oil baffle plate is arc-shaped and is arranged in the circumferential direction of the oil hole to block, to the greatest extent, the oil flowing out of the oil hole, so that the oil flows to the oil guide part through the opening, and drips quickly under the converging effect of the oil guide part. The oil baffle plate may also have other shapes.

In any of the above embodiments, furthermore, the number of oil holes is at least one, the number of oil guide parts is at least one, and the oil holes and the oil guide parts are arranged in one-to-one correspondence.

In this embodiment, the number of oil holes is at least one, and the oil guide part corresponds to the oil hole and is also in the number of at least one, thereby speeding up the outflow of oil in the housing and also speeding up the dripping of the oil, thus reducing the oil discharge amount of the compressor.

Furthermore, the oil guide part may be a rib or a groove.

In any of the above embodiments, furthermore, the shape of the oil guide part is any one of the followings: a prism, a cylinder, a platform and a cone.

In this embodiment, the oil guide part may have various shapes, such as a prism, a cylinder, a platform and a cone, and they all can have a good converging effect to cause oil to drip quickly.

Furthermore, the shape of the oil guide part is a cuboid or a cylinder.

In any of the above embodiments, furthermore, the oil guide part is a prism, and a length of the prism in the direction of dripping of oil is equal to a width of a cross section of the prism.

In this embodiment, when the oil guide part is a prism having equal height and width, the oil guiding effect of the oil guide part is better, that is, the oil guiding effect of the oil guide part is improved, thereby reducing the oil discharge amount of the compressor.

Furthermore, the shape of the oil guide part is a cube.

In any of the above embodiments, furthermore, the oil guide part is a platform, and a cross-sectional area of the platform gradually decreases in the direction of dripping of oil.

In this embodiment, when the oil guide part is a platform, the cross-sectional area of the platform gradually decreases in the direction of dripping of oil, then after flowing onto the oil guide part, the oil converges from an end with a larger area to an end with a smaller area, so that the oil converges better and will drip more quickly. Thus, when it is used in a compressor, the oil discharge amount of the compressor will be reduced.

In any of the above embodiments, furthermore, a height of the platform in the direction of dripping of oil is greater than or equal to 2 mm and smaller than or equal to 3 mm.

In this embodiment, the platform should not be too high. If the platform is too high, the effect of converging oil will be reduced and the overall height and cost will also be increased. The platform should not be too low. If the platform is too low, it cannot have a good converging effect on oil. Therefore, the height of the platform is limited to be greater than or equal to 2 mm and smaller than or equal to 3 mm, which improves the converging effect on oil while reducing the production cost.

In any of the above embodiments, furthermore, the platform is a circular truncated cone. One planar surface of the circular truncated cone has a diameter greater than or equal to 1 mm and smaller than or equal to 2 mm, and the other planar surface of the circular truncated cone has a diameter greater than or equal to 0.5 mm and smaller than or equal to 1 mm.

In this embodiment, the platform is a circular truncated cone. The diameter of the smaller planar surface of the circular truncated cone is greater than or equal to 0.5 mm and smaller than or equal to 1 mm, and the diameter of the larger planar surface of the circular truncated cone is greater than or equal to 1 mm and smaller than or equal to 2 mm, which ensures the converging effect of the platform on oil, and can also reduce the production cost.

In any of the above embodiments, furthermore, a draft angle of the platform is greater than or equal to 10° and smaller than or equal to 30°.

In this embodiment, the platform can be manufactured by a mold, and the draft angle of the platform being greater than or equal to 10° and smaller than or equal to 30° is beneficial to demolding of the platform.

In any of the above embodiments, furthermore, the housing and the oil guide part are a one-piece structure or a split structure.

In this embodiment, the housing and the oil guide part may be a one-piece structure or a split structure. When the housing and the oil guide part are a one-piece structure, the one-piece structure has good mechanical properties and reliable connection, which makes the connection between the oil guide part and the housing more reliable, and also enables manufacturing of the housing and the oil guide part together, thus facilitating the manufacturing and reducing the manufacturing cost. When the housing and the oil guide part area split structure, it is convenient to disassemble the oil guide part and the housing.

According to the second aspect of the present disclosure, a compressor is further proposed, comprising: a shell; and the silencing device described in any of the above embodiments, wherein the silencing device is arranged in the shell, and oil dripping from the silencing device can fall into an oil pool of the compressor.

The compressor provided in the second aspect of the present disclosure comprises the silencing device described in any of the above embodiments, and therefore has all the beneficial effects of the silencing device.

For example, the compressor is a reciprocating compressor.

Additional aspects and advantages of the present disclosure will become apparent in the following description, or are understood by the practice of the present disclosure.

BRIEF DESCRIPTION OF DRAWINGS

The above and/or additional aspects and advantages of the present disclosure will become apparent and readily understood from the following description of embodiments in conjunction with the drawings.

Figure 1:
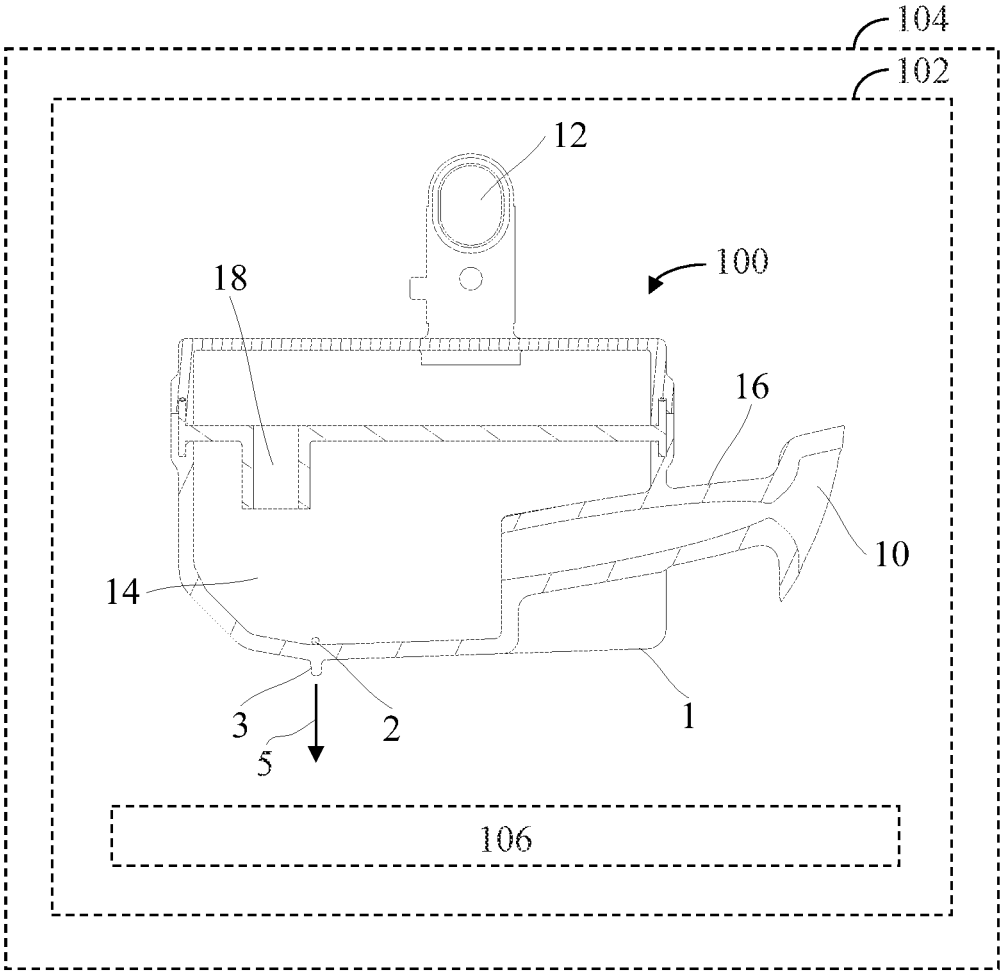
FIG. 1 is a sectional front view of a silencing device according to an embodiment of the present disclosure.

The following is a description of reference numerals in the drawing figures:

1 housing, 10 air inlet, 100 silencing device, 102 shell, 104 compressor, 106 oil pool, 11 larger planar surface, 12 air outlet, 13 smaller planar surface, 14 air flow channel, 15 draft angle, 16 air inlet pipe, 18 air outlet pipe, 2 oil hole, 3 oil guide part, 4 oil baffle plate, 5 oil dripping direction, 6 prism length, 7 prism width, and 8 platform height.

DETAILED DESCRIPTION OF EMBODIMENTS

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure may also be implemented in other manners than those described herein. Therefore, the protection scope of the present disclosure is not limited to the specific embodiments disclosed below.

A silencing device and a compressor according to some embodiments of the present disclosure are described below with reference to FIGS. 1-7.

According to an embodiment of the first aspect of the present disclosure, the present disclosure proposes a silencing device 100, comprising: a housing 1, wherein an air inlet 10 and an air outlet 12 are provided on the housing 1, the housing 1 is internally provided with an air flow channel 14, and the air inlet 10 and the air outlet 12 are in communication with each other by means of the air flow channel 14; an oil hole 2 provided in the housing 1 for discharging oil from the housing 1; and an oil guide part 3 arranged on the housing 1 and located on an outer side of the housing 1, wherein the oil guide part 3 is arranged below or downstream of the oil hole 2 in the moving, flowing or dripping direction 5 of the oil (e.g., oil dripping direction), such that the oil drips out of the housing 1 after flowing from the oil hole 2 to the oil guide part 3.

As shown in FIGS. 1-7, a refrigerant gas can enter through the air inlet 10, pass through the air flow channel 14, and flow out from the air outlet 12 after being subjected to an oil-gas separation in the air flow channel 14. The resultant oil flows out through the oil hole 2. The oil guide part 3 is arranged on the outer side of the housing 1 and located below the oil hole 2, so that oil will flow to the oil guide part 3 after flowing out from the oil hole 2. The oil guide part 3 increases the surface adsorption force of the oil, such that the oil can better converge; and when reaching a certain gravity, converged oil drops or streams can quickly drip into the bottom of a housing 1 of a compressor, such that the oil discharge amount of the compressor can be effectively reduced, and stable internal oil circulation is ensured, thereby facilitating a reduction in the noise of the compressor.

Furthermore, the oil hole 2 is provided in a lower part of the housing 1, and is located downstream of an air flow in the air flow channel 14, to facilitate the oil's flowing out of the housing 1.

In the above embodiment, the oil hole 2 can be provided on a side wall of the housing 1, and the oil guide part 3 can be located on a bottom wall of the housing 1.

As shown in FIGS. 3-6, in this embodiment, the oil hole 2 is provided on the side wall of the housing 1, which facilitates the outflow of oil in the housing 1. The oil guide part 3 is provided on the bottom wall of the housing 1. After flowing out from the oil hole 2, oil flows along the side wall of the housing 1 to the bottom wall of the housing 1. Providing the oil guide part 3 on the bottom wall of the housing 1 is more conducive to converging the oil, so that the oil drips quickly, thereby reducing the oil discharge amount of the compressor. The oil hole 2 may also be provided on the bottom wall of the housing 1.

In any of the above embodiments, the housing 1 may comprise: an air inlet pipe 16, the air inlet 10 being arranged on the air inlet pipe 16 and communicated with the air flow channel 14 through the air inlet pipe 16; an air outlet pipe 18, the air outlet 12 being communicated with the air flow channel 14 through the air outlet pipe 18, wherein the oil hole 2 is arranged on an extension line of the air inlet pipe 16 in the air inflow direction.

Figure 2:
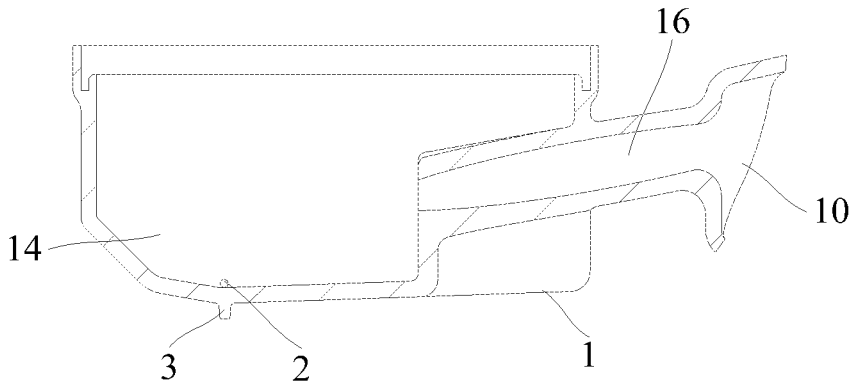
FIG. 2 is another sectional front view of a silencing device according to an embodiment of the present disclosure.
Figure 3:
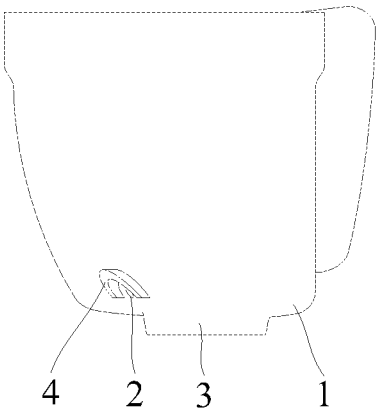
FIG. 3 is a schematic structural diagram side view of a silencing device according to an embodiment of the present disclosure.

As shown in FIGS. 1 and 2, in this embodiment, the housing 1 comprises an air inlet pipe 16 and an air outlet pipe 18, and the oil hole 2 is arranged on an extension line of the air inlet pipe 16 in the air inflow direction, that is, the oil hole 2 is arranged in the flowing direction of the refrigerant gas. The refrigerant gas enters from the air inlet 10 and flows to the air flow channel 14 through the air inlet pipe 16. To arrange the oil hole 2 in the gas flowing direction is more conducive to discharging the oil in the housing 1.

In any of the above embodiments, the silencing device may further comprise an oil baffle plate 4 arranged on the housing 1 (for example, on an outer surface of the housing 1) and located on a peripheral side of the oil hole 2 or at least partially around the oil hole 2.

As shown in FIGS. 3-7, in this embodiment, the silencing device further comprises an oil baffle plate 4 located on the peripheral side of the oil hole 2. After flowing out from the oil hole 2, the oil may adhere to the vicinity of the oil hole 2 or flow to other places. In order to prevent the oil discharged from the housing 1 from being sucked into the housing 1 again, the oil baffle plate 4 is arranged on the peripheral side of the oil hole 2, which, on the one hand, prevents the oil from being sucked into the housing 1 again; and on the other hand, blocks the oil so that the oil flows towards the oil guide part 3.

In any of the above embodiments, the oil baffle plate 4 can be arc-shaped and arranged in a circumferential direction of the oil hole 2, wherein an opening is provided on the oil baffle plate 4 and the opening is provided to face the oil guide part 3.

As shown in FIGS. 3-6, in this embodiment, the oil baffle plate 4 is arc-shaped and is arranged in the circumferential direction of the oil hole 2 to block, to the greatest extent, the oil flowing out of the oil hole 2, so that the oil flows to the oil guide part 3 through the opening, and drips quickly under the converging effect of the oil guide part 3. The oil baffle plate 4 may also have other shapes.

In any of the above embodiments, the number of oil holes 2 can be at least one, the number of oil guide parts 3 can be at least one, and the oil holes 2 and the oil guide parts 3 can be arranged in one-to-one correspondence.

In this embodiment, the number of oil holes 2 is at least one, and the oil guide part 3 corresponds to the oil hole and is also in the number of at least one, thereby speeding up the outflow of oil in the housing 1 and also speeding up the dripping of the oil, thus reducing the oil discharge amount of the compressor.

Furthermore, the oil guide part 3 may be a rib or a groove.

In any of the above embodiments, the shape of the oil guide part 3 can be any one of the followings: a prism, a cylinder, a platform and a cone.

Figure 4:
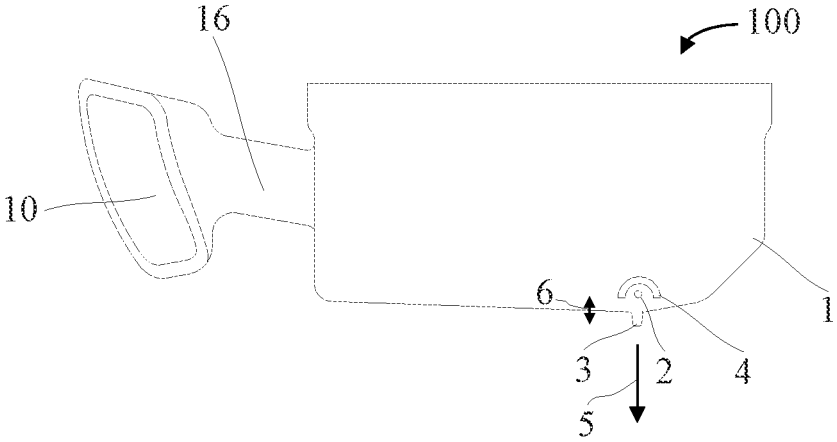
FIG. 4 is another schematic structural diagram back view of a silencing device according to an embodiment of the present disclosure.
Figure 5:
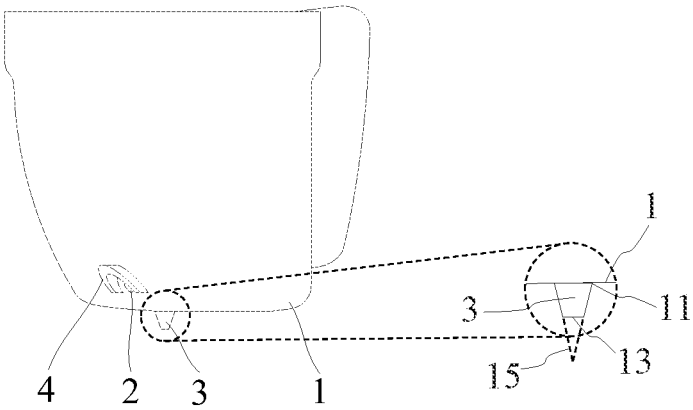
FIG. 5 is a further schematic structural diagram side view of a silencing device according to an embodiment of the present disclosure.
Figure 6:
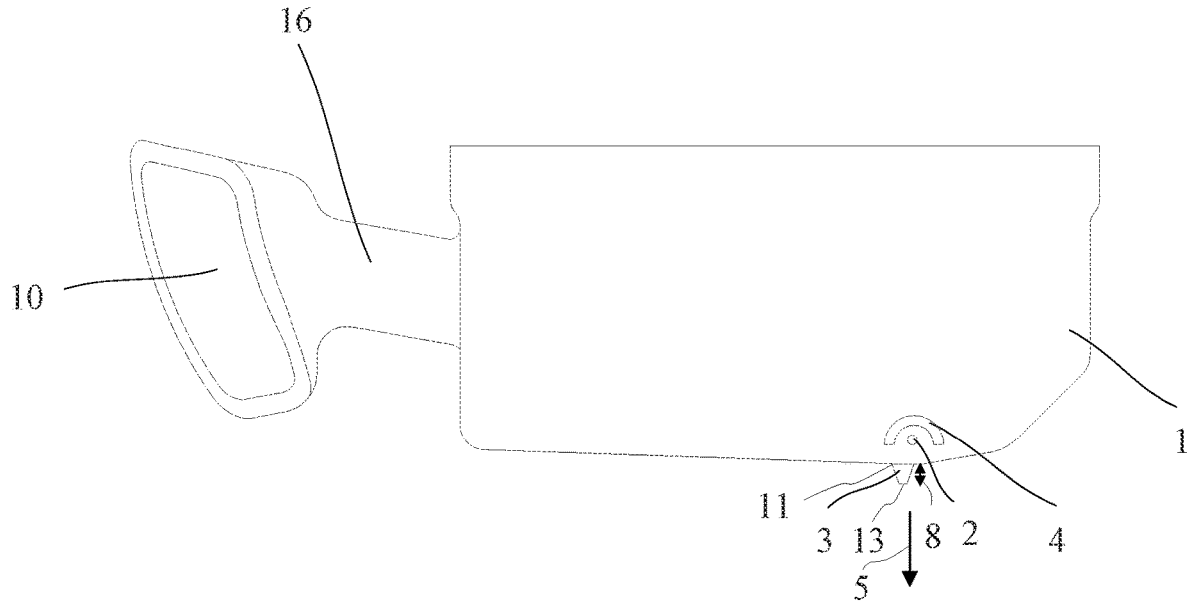
FIG. 6 is a still further schematic structural diagram back view of a silencing device according to an embodiment of the present disclosure.
Figure 7:
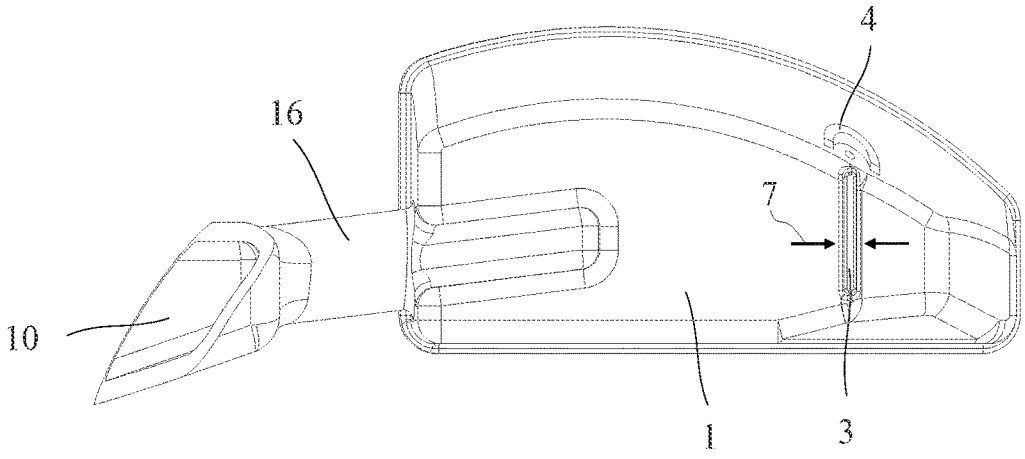
FIG. 7 is a still further schematic structural diagram bottom view of a silencing device according to an embodiment of the present disclosure.

As shown in FIGS. 4-6, in this embodiment, the oil guide part 3 may have various shapes, such as a prism, a cylinder, a platform and a cone, and they all can have a good converging effect to cause oil to drip quickly.

Furthermore, the shape of the oil guide part 3 is a cuboid or a cylinder.

In any of the above embodiments, the oil guide part 3 can be a prism, and a length 6 of the prism in the direction of dripping of oil 5 is equal to a width 7 of a cross section of the prism.

In this embodiment, when the oil guide part 3 is a prism having equal height and width, the oil guiding effect of the oil guide part 3 is better, that is, the oil guiding effect of the oil guide part 3 is improved, thereby reducing the oil discharge amount of the compressor.

Furthermore, the shape of the oil guide part 3 is a cube.

In any of the above embodiments, the oil guide part 3 can be a platform, and a cross-sectional area of the platform gradually decreases in the direction of dripping of oil.

As shown in FIGS. 5 and 6, in this embodiment, when the oil guide part 3 is a platform, the cross-sectional area of the platform gradually decreases in the direction of dripping of oil, then after flowing onto the oil guide part 3, the oil converges from an end with a larger area to an end with a smaller area, so that the oil converges better and will drip more quickly. Thus, when it is used in a compressor, the oil discharge amount of the compressor will be reduced.

In any of the above embodiments, a height 8 of the platform in the direction of dripping of oil 5 can be greater than or equal to 2 mm and smaller than or equal to 3 mm.

In this embodiment, the platform should not be too high. If the platform is too high, the effect of converging oil will be reduced and the overall height and cost will also be increased. The platform should not be too low. If the platform is too low, it cannot have a good converging effect on oil. Therefore, the height of the platform is limited to be greater than or equal to 2 mm and smaller than or equal to 3 mm, which improves the converging effect on oil while reducing the production cost.

In any of the above embodiments, the platform can be a circular truncated cone. One planar surface 11 of the circular truncated cone has a diameter greater than or equal to 1 mm and smaller than or equal to 2 mm, and the other planar surface 13 of the circular truncated cone has a diameter greater than or equal to 0.5 mm and smaller than or equal to 1 mm.

In this embodiment, the platform is a circular truncated cone. The diameter of the smaller planar surface 13 of the circular truncated cone is greater than or equal to 0.5 mm and smaller than or equal to 1 mm, and the diameter of the larger planar surface 11 of the circular truncated cone is greater than or equal to 1 mm and smaller than or equal to 2 mm, which ensures the converging effect of the platform on oil, and can also reduce the production cost.

In any of the above embodiments, a draft angle 15 of the platform can be greater than or equal to 10° and smaller than or equal to 30°.

In this embodiment, the platform can be manufactured by a mold, and the draft angle of the platform being greater than or equal to 10° and smaller than or equal to 30° is beneficial to demolding of the platform.

In any of the above embodiments, the housing 1 and the oil guide part 3 can be a one-piece structure or a split structure.

In this embodiment, the housing 1 and the oil guide part 3 may be a one-piece structure or a split structure. When the housing 1 and the oil guide part 3 are a one-piece structure, the one-piece structure has good mechanical properties and reliable connection, which makes the connection between the oil guide part 3 and the housing 1 more reliable, and also enables manufacturing of the housing 1 and the oil guide part 3 together, thus facilitating the manufacturing and reducing the manufacturing cost. When the housing 1 and the oil guide part 3 area split structure, it is convenient to disassemble the oil guide part 3 and the housing 1.

According to the second aspect of the present disclosure, a compressor 104 is further proposed, comprising: a shell 102; and the silencing device described in any of the above embodiments, wherein the silencing device is arranged in the shell, and oil dripping from the silencing device can fall into an oil pool 106 of the compressor.

The compressor provided in the second aspect of the present disclosure comprises the silencing device provided in any of the above embodiments, and therefore has all the beneficial effects of the silencing device.

For example, the compressor is a reciprocating compressor.

In the present disclosure, the term "a plurality of" means two or more, unless otherwise explicitly defined. The terms "mounting", "connected", "connection", "fixing" and the like should be understood in a broad sense, for example, "connection" may be a fixed connection, and may also be a removable connection, or an integral connection; and "connected" may refer to direct connection and may also refer to indirect connection through an intermediary. A person of ordinary skills in the art could understand the specific meaning of the terms in the present disclosure according to specific situations.

In the description of the specification, the descriptions of the terms "one embodiment", "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. A silencing device comprising:

a housing, having an air inlet and an air outlet and an internal air flow channel, and the air inlet and the air outlet being in communication with each other through the air flow channel;

an oil hole, provided in the housing for discharging oil from the housing; and an oil guide part, arranged on an outer surface of the housing, wherein the oil guide part is arranged downstream of the oil hole in a flowing direction of the oil from the oil hole, such that the oil drips from the housing after the oil flows from the oil hole to the oil guide part, wherein the oil hole is provided in a side wall of the housing, and wherein the oil guide part is arranged on an outer surface of a bottom wall of the housing.

2. The silencing device according to claim 1, wherein the oil guide part is arranged downstream of the oil hole in the flowing direction of the oil such that the oil drips out of the housing after flowing from the oil hole to the oil guide part.

3. The silencing device according to claim 1, wherein the housing comprises:

an air inlet pipe, the air inlet being arranged on the air inlet pipe and communicated with the air flow channel through the air inlet pipe; and an air outlet pipe, the air outlet being communicated with the air flow channel through the air outlet pipe, wherein the oil hole is arranged on an extension line of the air inlet pipe in an air inflow direction.

4. The silencing device according to claim 1, further comprising:

an oil baffle plate, arranged on the housing and located on a peripheral side of the oil hole.

5. The silencing device according to claim 4, wherein:

the oil baffle plate is arc-shaped and is arranged in a circumferential direction of the oil hole, wherein an opening is provided on the oil baffle plate, and the opening is arranged to face the oil guide part.

6. The silencing device according to claim 1, wherein:

the number of oil holes is at least one, the number of oil guide parts is at least one, and the oil holes and the oil guide parts are arranged in one-to-one correspondence.

7. The silencing device according to claim 1, wherein:

the shape of the oil guide part is any one of the followings: a prism, a cylinder, a platform and a cone.

8. The silencing device according to claim 7, wherein:

the shape of the oil guide part is the prism, and a length of the prism in the direction of dripping of oil is equal to a width of a cross section of the prism.

9. The silencing device according to claim 7, wherein:

the shape of the oil guide part is the platform, and a cross-sectional area of the platform gradually decreases in the direction of dripping of oil.

10. The silencing device according to claim 9, wherein:

a height of the platform in the direction of dripping of oil is greater than or equal to 2 mm and smaller than or equal to 3 mm; and/or the platform is a circular truncated cone, one planar surface of the circular truncated cone has a diameter greater than or equal to 1 mm and smaller than or equal to 2 mm, and the other planar surface of the circular truncated cone has a diameter greater than or equal to 0.5 mm and smaller than or equal to 1 mm; and/or a draft angle of the platform is greater than or equal to 10° and smaller than or equal to 30°.

11. The silencing device according to claim 1, wherein:

the housing and the oil guide part are a one-piece structure or a split structure.

12. A compressor comprising:

a shell; and the silencing device according to claim 1, wherein the silencing device is arranged in the shell, and the oil dripping from the silencing device falls into an oil pool of the compressor.

13. A compressor comprising:

a shell; and a silencing device arranged in the shell, the silencing device comprising:

a housing, having an air inlet and an air outlet and an internal air flow channel, and the air inlet and the air outlet being in communication with each other through the air flow channel;

an oil hole arranged in a side wall of the housing for discharging oil from the housing; and an oil guide part arranged on an outer surface of a bottom wall of the housing, wherein the oil guide part is arranged downstream of the oil hole in a flowing direction of the oil from the oil hole such that the oil that drips out of the housing after flowing from the oil hole to the oil guide part, the oil dripping from the silencing device falls from the oil guide part into an oil pool of the compressor.

14. The compressor of claim 13, wherein:

the shape of the oil guide part is any one of the followings: a prism and a platform.

15. The compressor of claim 14, wherein:

the shape of the oil guide part is the prism, and a length of the prism in the direction of dripping of oil is equal to a width of a cross section of the prism.

16. The compressor of claim 14, wherein:

the shape of the oil guide part is the platform, and a cross-sectional area of the platform gradually decreases in the direction of dripping of oil.

17. The compressor of claim 16, wherein:

a height of the platform in the direction of dripping of oil is greater than or equal to 2 mm and smaller than or equal to 3 mm; and/or the platform is a circular truncated cone, one planar surface of the circular truncated cone has a diameter greater than or equal to 1 mm and smaller than or equal to 2 mm, and the other planar surface of the circular truncated cone has a diameter greater than or equal to 0.5 mm and smaller than or equal to 1 mm; and/or a draft angle of the platform is greater than or equal to 10° and smaller than or equal to 30°.

* * * * *